US006449925B1

(12) United States Patent
Otsu et al.

(10) Patent No.: US 6,449,925 B1
(45) **Date of Patent: *Sep. 17, 2002**

(54) METHOD FOR PREPARING INCLUSION PACKAGED PRODUCT

(75) Inventors: Kyoichi Otsu; Naoko Yamashita, both of Hyogo; Yoshiji Okumura, Osaka; Toshio Miyake, Okayama, all of (JP)

(73) Assignee: Kabushiki Kaisha Hayashibara Seibutsu Kagaku Kenkyujo, Okayama (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/379,786

(22) Filed: Aug. 24, 1999

Related U.S. Application Data

(62) Division of application No. 08/980,289, filed on Nov. 28, 1997.

(30) Foreign Application Priority Data

Nov. 29, 1996 (JP) ..... 8-333057

(51) Int. Cl.[7] ..... B65B 63/00

(52) U.S. Cl. ..... 53/428; 428/336; 53/427; 53/440; 53/509

(58) Field of Search ..... 428/40.1, 42.2, 428/336; 206/812, 823, 828; 53/411, 427, 440, 442, 509, 428

(56) References Cited

U.S. PATENT DOCUMENTS

| | | | | |
|---|---|---|---|---|
| 3,007,848 A | * | 11/1961 | Stroop | 53/427 |
| 3,938,659 A | * | 2/1976 | Wardwell | 206/439 |
| 4,253,364 A | * | 3/1981 | Kiefer et al. | 53/509 |
| 4,413,172 A | * | 11/1983 | Jones | 53/509 |
| 4,938,951 A | * | 7/1990 | Leung et al. | 424/59 |
| 5,069,018 A | * | 12/1991 | Puett | 53/509 |

* cited by examiner

*Primary Examiner*—John Paradiso
(74) *Attorney, Agent, or Firm*—Browdy and Neimark

(57) ABSTRACT

An inclusion package product is produced by coating a base sheet with a solution of and inclusion article; drying the solution coated onto the base sheet; and placing an overlapping sheet onto the base sheet and sealing prescribed sections of the base sheet to the overlapping sheet to surround the area coated with the solution.

10 Claims, 3 Drawing Sheets

METHOD FOR PREPARING INCLUSION PACKAGED PRODUCT

CROSS-REFERENCE TO RELATED APPLICATIONS

The present application is a divisional of application Ser. No. 08/980,289 filed Nov. 28, 1997, the entire contents of which are hereby incorporated by reference.

FIELD OF THE INVENTION

The present invention is directed to a process for producing an inclusion packaged product which comprises a thin-leaf article enclosed in a package.

BACKGROUND OF THE INVENTION

Recently, laminated cachous (i.e., pills or pastilles for sweetening the breath) have become popular. For example, as disclosed in Japanese Patent Kokai No. 236,885/93, conventional cachous are prepared by shaping compositions, which contain, along with polysaccharides which can be formed into membranes, viscous stabilizers, plasticizers, flavors, sweeteners, substances with acidity or sour taste, and extracts, into sheet-like products and cutting the sheet-like products into thin leaves. The cachous thus obtained are packaged into containers in a prescribed number of leaves, then supplied to users. These cachous are, however, relatively small in size and are easily stuck together so that they could be packaged by hand individually in containers while counting, which increases the production cost.

There has been an effort to shape products other than cachous into thin-leaf products for foods, cosmetics, and pharmaceuticals. These thin-leaf products are easily handled and transportable for the users, and can be advantageously used in any number wherever one is, i.e., indoors or outdoors, by removing the thin leaves from their containers. From the producers' side, however, there is still a difficulty in handling these products during packaging. In some cases, the products are supplied to users unpackaged in order to lower the production costs of the products.

The output of thin leaf products described above directly reflects today's diversified consuming life style. There is a strong demand for a packaging technique for thin leaf products that fulfills the users' need and ensure satisfactory hygiene and handleability.

SUMMARY OF THE INVENTION

In view of the foregoing, the first object of the present invention is to provide an inclusion packaged product contain a thin leaf inclusion article which has satisfactory handleability and which does not come in contact with the atmosphere.

The second object of the present invention is to provide a process for producing such an inclusion packaged product at a relatively low production cost.

The present inventors' energetic study revealed that the above objects can be attained by an inclusion packaged product comprising an inclusion cell formed by a base sheet and an overlapping sheet, and a thin leaf inclusion article enclosed in the inclusion cell in a manner such that it can be freely detached from the base sheet.

The first object of the present invention is solved by an inclusion packaged product comprising an inclusion cell formed by a base sheet and an overlapping sheet, and a thin leaf inclusion article enclosed in the inclusion cell in a manner such that it can be freely detached from the base sheet.

The second object of the present invention is attained by providing a process for producing the inclusion packaged product, which comprises the steps of:

(1) coating a base sheet with a solution of an inclusion article;

(2) drying the coated solution; and (3) placing an overlapping sheet onto the base sheet and sealing prescribed sections of the sheets to surround the area coated with the solution.

Figure 1:
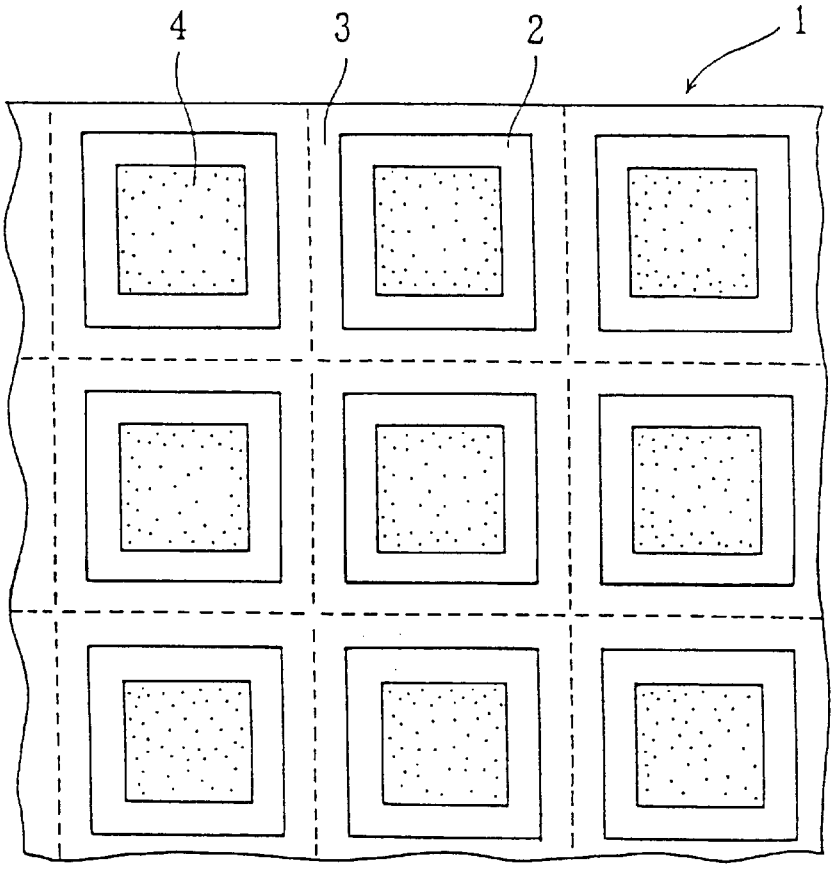
FIG. 1 is the plan view of the inclusion packaged product according to the present invention.

Throughout the figures, the reference numeral "1" shows an inclusion packaged product; "2", inclusion cell; "3", sealed section; "4", thin leaf inclusion article; "5", base sheet reservoir roll; "6", base sheet; "7", "8", and "9", sending rolls; "10", product winding roll; "11", coating roll; "12", reservoir tank; "13", projection; "14", dryer; "15", reservoir roll for overlapping sheet; "16", overlapping sheet; and "17", sealing machine.

DETAILED DESCRIPTION OF THE INVENTION

Figure 2:
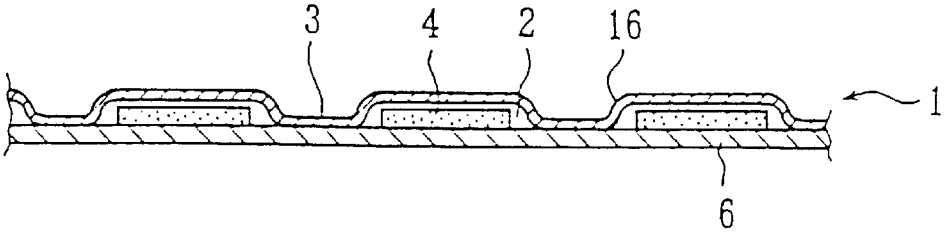
FIG. 2 is a longitudinal side elevation view of the inclusion packaged product according to the present invention.

Describing the preferred embodiment of the present invention with reference to the accompanying drawings, FIGS. 1 and 2 are, respectively, a plan view and a longitudinal side elevation view of the inclusion packaged product according to the present invention. In these figures, reference numeral "1" shows the present inclusion packaged product; reference numeral "2", an inclusion cell; reference numeral "3", a sealed section; reference numeral "4", a thin leaf inclusion article; reference numeral "6", a base sheet; and reference numeral "16", an overlapping sheet.

As can be seen from FIG. 2, inclusion cell 2 is formed by overlapping base sheet 6 and overlapping sheet 16 together, and sealing prescribed sections of the sheets by a technique such as heat sealing to form sealed section 3. The sealing around the inclusion cell 2 enables articles to be kept from contact with the atmosphere. Although base sheet 6 and overlapping sheet 16 in FIG. 2 are separately prepared and provided as two sheets, inclusion cell 2 may be formed by folding one sheet into two sheets, i.e., one for base sheet 6 and the other for overlapping sheet 16, and sealing the prescribed sections of the sheets. The sealing technique is not restricted to heat sealing. Sealing can be effected using adhesives or ultrasound. Alternatively, adhesion, melting, deposition, and fixing can also be appropriately used, depending upon the materials used for the base and overlapping sheets.

In the inclusion packaged product 1 according to the present invention, the number of inclusion cells 2 formed together is not restricted to any number of inclusion cells. for example, several inclusion cells can be arranged in a row or rows. Preferably, to reduce production costs, at least three inclusion cells 2 are provided vertically and horizontally on base sheet 6 at prescribed intervals. Such an arrangement can easily be provided by the process of the present invention. In actual use, sealed section 3 provided around inclusion cell 2 is usually formed to provide a considerable width and can be provided with perforations to facilitate cutting, as shown by the broken lines in FIG. 1. Notch and depth of cutting, not shown in the figure, can be provided to facilitate cutting of base sheet 6 and overlapping sheet 16. Alternatively, base sheet 6 and overlapping sheet 16 can be processed to be easily cut in a prescribed direction.

As shown in FIG. 2, thin leaf inclusion article 4 is enclosed within inclusion cell 2 in a manner that it can be freely detached from base sheet 6. Inclusion article 4 is usually placed individually into n inclusion cell so that it can be made in a size slightly smaller than that of inclusion cell 2. As described later, inclusion article 4 can be formed by coating base sheet 6 with a solution of inclusion article 4 to allow the inclusion article 4 to adhere to base sheet 6, normally in an adhesion strength level such that it can be easily detached by the user's fingertips.

Base sheet 6 and overlapping sheet 16 are usually made of moisture-proof and thermostable materials such as sheets of synthetic polymers, semisynthetic polymers, and natural polymers. The types of polymers are not specifically restricted, but are preferably those which can be used with foods, cosmetics, or pharmaceuticals. Examples of such polymers are polyethylene, polypropylene, ethylene acetic vinyl polymer, polyvinyl acetate, polyvinyl chloride, polyvinylidene chloride, polytetra fluoroethylene, polyvinylidene fluoride, polystyrene, polyacrylonitrile, polyacrylate, polymethacrylic acid, ethylene/polypropylene copolymer, ethylene/acrylic acid copolymer, ethylene/methacrylic acid copolymer, propylene/vinylchloride copolymer, ethylene/vinyl alcohol copolymer, polyethylene terephthalate, polybutylene terephthalate, polycarbonate, nylon, normal cellophane, moistureproof cellophane, cellulose acetate, carboxymethyl cellulose, polyvinyl alcohol, hydrochlorinated rubbers, papers, and aluminum foil.

If necessary, the polymer can be appropriately used in combination by laminating, or the polymer can be treated with opacifiers or coloring materials before use. The thickness of the sheets is not restricted, and can be selected depending upon the purposes used. Nevertheless, to facilitate the process, base sheet 6 and overlapping sheet 16 are preferably processed to have an equal thickness of about 1–100 $\mu$m, more preferably, about 10–50 $\mu$m, or the base sheet can preferably be processed to be thicker than the overlapping sheet.

The think leaf inclusion article 4 can be prepared by using, as a base, water-soluble polymers, preferably water soluble polysaccharides which form membranes, which can be used in foods, cosmetics, and pharmaceuticals. Examples of such water-soluble polymers are amylose, gum arabic, sodium alginate, elsinan, curdlan, carrageenan, karya gum, agar, xanthan gum, chitin, guar gum, quince seed gum, mannan, gelatin, cellulose, tamarind gum, dextran, starches, tragacanth gum, pectin, pullulan, polyvinyl alcohol, locust bean gum, and derivatives thereof. These water-soluble polymers can be arbitrarily used in combination. Among these polymers, gum arabic, dextran, and pullulan are more preferably used because of their superior water solubility and ability to form membranes. More particularly, the use of pullulan makes it possible to produce inclusion packaged products with a satisfactory flexibility, transparency, and quality.

The types and proportions of the ingredients of inclusion article 4 vary depending upon the purpose for which the inclusion article is intended. When the present invention is used for food products, the following ingredients can be used in adequate amounts after being pulverized: seasonings such as sodium inosinate, sodium guanylate, sodium glutamate, soy sauces, misos, sauces, sakes, foreign wines, mirins, vinegars, and salts; extract seasonings such as yeast extracts, meat extracts, fish meat extracts, vegetable extracts, fruit extracts, seaweed extracts, and propolises; souring agents such as adipic acid, citric acid, δ-D-gluconolactone, gluconic acid acetic acid, tartaric acid, succinic acid, lactic acid, and malic acid; sweeteners such as hydrangea, glycyrrhizin, stevioside, rebaudioside, peptide sweeteners, saccharin, and cyclamate; flavors such as origanum oil, grapefruit oil, sweet orange oil, davana oil, Japanese mint oil, vanilla oil, hyssop oil, bitter almond oil, bitter orange oil, peppermint oil, perilla, mandarin oil, lemon oil, and rose oil; seasonings such as cassia, capsicum, cumin, clary sage, coriander, cinnamon, ginger, thyme, nutmeg, pepper, and mustard; and food materials such as process or unprocessed meats, fish meats, vegetables, fruits, seaweeds, and mushrooms. When using oil-soluble flavors, the flavors can be previously emulsified in a conventional manner prior to use.

When the present invention is used for pharmaceuticals, the following pharmaceutically acceptable ingredients can be used in effective amounts: anodynes/antiphlogistics such as acetaminophen, phenacetin, aspirin, aminopyrine, dipyron, oxyphenbutazone, phenylbutazone, mefenamic acid, flufenamic acid, diclofenac, alclofenac, ibuprofen, flurbiprofen, salicylic acid, methyl salicylate, menthol, camphor, sulindac, sodium tolmetinate, naproxen, fenbufen, indomethacin, and colchicine; antiphlogistic enzymes such as α-chymotrypsin; antiphlogistic steroids such as hydrocortisone, prednisolone, triamcinolone, dexamethasone, and betamethasone; antihistamines such as diphenhydramine hydrochloride and dexchlorpheniramine maleate; antibiotics and germicides such as tetracycline, leucomycin or kitasamycin, fradiomycin, penicillin and derivatives thereof, cephalosporin derivatives, chloramphenicol, fradiomycin and derivatives thereof, and erythromycin; chemotherapeutic agents such as sulofathiazole and nitrofurazone; anesthetics such as lidocaine and benzocaine; cardiacs such as digitalis and digoxin; vasodilators such as nitroglycerin and papaverine hydrochloride; antitussives and expectorants such as codeine phosphate and isoproterenol sulfate; oral bactericides such as chlorhexidine hydrochloride, 4-hexyl resorcinol, and ethacridine; drugs for digestive organs such as pepstatin, azulene, phenolphthalein, and methylmethionine sulfonium chloride; hypoglycemic agents such as insulin; and other drugs such as hemostatics, hypotensive agents, sedatives, anti-verigeneous drugs, antitumor agents, crude drug extracts, and vitamins. When these pharmaceutical ingredients are used, they are placed into each cell 2 provided in the inclusion packaged product 1, and afterwards formed into thin leaf inclusion articles which contain sufficient amounts of the ingredients in a unit dose form or a divisor dose form with respect to each ingredients. The pharmaceuticals thus obtained can be administered to humans via peroral, intubation, percutaneous, and permucosal administration to treat and/or to prevent diseases.

Alternative ingredients that can be incorporated in inclusion article 4 include cosmetically acceptable ingredients such as foundation, rouge, eye shadow, eye brow colorants, pearl coloring compounds, basal creams, agents for growth and regeneration of hair, and bath salts. Other ingredients include cosmetic colors, crude drug extracts, ultraviolet absorbing agents, and skin beautifying ingredients, flavors, and ingredients for growth and regeneration of hair.

The present invention can also be used in agriculture, including for plant seeds, fertilizers, pet foods, and feeds.

As described above, the inclusion packaged product according to the present invention can be widely applicable to any food product, cosmetic, and pharmaceutical. In any case, to stabilize the ingredients, improve the properties of the thin leaf inclusion articles, and control the release strength of the inclusion articles from the base sheet, the following ingredients can be used in combination with the above ingredients: viscosity-imparting agents such as oligosaccharides, and dextrins; humectants such as glycerin, xylitol, sorbitol, propylene, sodium lactate, sodium pyrrolidone carbonate, polyethylene glycol, carboxymethyl cellulose, alginic acid, serine, maltitol, galactosamine, soluble collagen, elastin, sodium hyaluronate, chondroitin sulfate, and aspartic acid; surfactants such as sucrose fatty acid ester, maltose fatty acid ester, maltitol fatty acid ester, trehalose fatty acid ester, and fatty acid glycerol ester; and others such as emulsifiers, colorants, stabilizers, antioxidants, preservatives, and germicides. Inclusion articles with printed pictures using adequate colorants can also be used as transfer sheets for printing pictures on food products and the like.

The inclusion packaged product according to the present invention can be produced by a variety of methods; usually it can be produced by forming a thin leaf inclusion article on the base sheet, laminating an overlapping sheet onto the base sheet, and sealing the adequate sections of the sheets. A solution containing about 10–50 w/w % of any o the above water-soluble polymers preferably about 20–40 w/w %, is prepared, and then mixed with one or more ingredients depending upon the purpose of the thin leaf inclusion article. While this may vary depending upon the types and uses of the ingredients, incorporation of excessive amounts of the ingredients may lower the flexibility and/or solubility of the thin leaf inclusion articles so that ingredients that exert a satisfactory activity with only a small amount are preferably incorporated in the solution in as low a concentration as possible, usually in an amount of not more than about 40%, preferably not more than 30% of the water soluble polymer used, on a dry solid basis (d.s.b.). These ingredients can be dissolved or in suspension forms as solids of sizes that do not hinder formation of thin leaves. The solutions for inclusion articles thus obtained can be intermittently coated onto a plurality of sections on the base sheet at prescribed intervals, and dried at temperatures above ambient temperatures, usually, about 40–100° C., preferably 60–90° C., to form thin leaf inclusion articles. An overlapping sheet is laminated onto either side with the thin leaf inclusion articles formed on the base sheet, so that the inclusion articles are enclosed in inclusion cells formed between the base sheet and the overlapping sheet by sealing prescribed sections of the sheets to surround the articles and to be freely detachable by a technique such as heat sealing.

The thickness of the thin leaf inclusion articles can be varied depending upon the purposes for which they are intended, and are easily controlled within the range of about 10–500 $\mu$m, preferably about 10–100 $\mu$m, by appropriately changing the concentration of water soluble polymers and the coating rate of the solutions, etc. The above inclusion packaged product with a satisfactorily high quality is continuously produced by the present process at the lowest possible cost using a minimum of labor.

The present invention will be explained with reference to FIG. 3.

Figure 3:
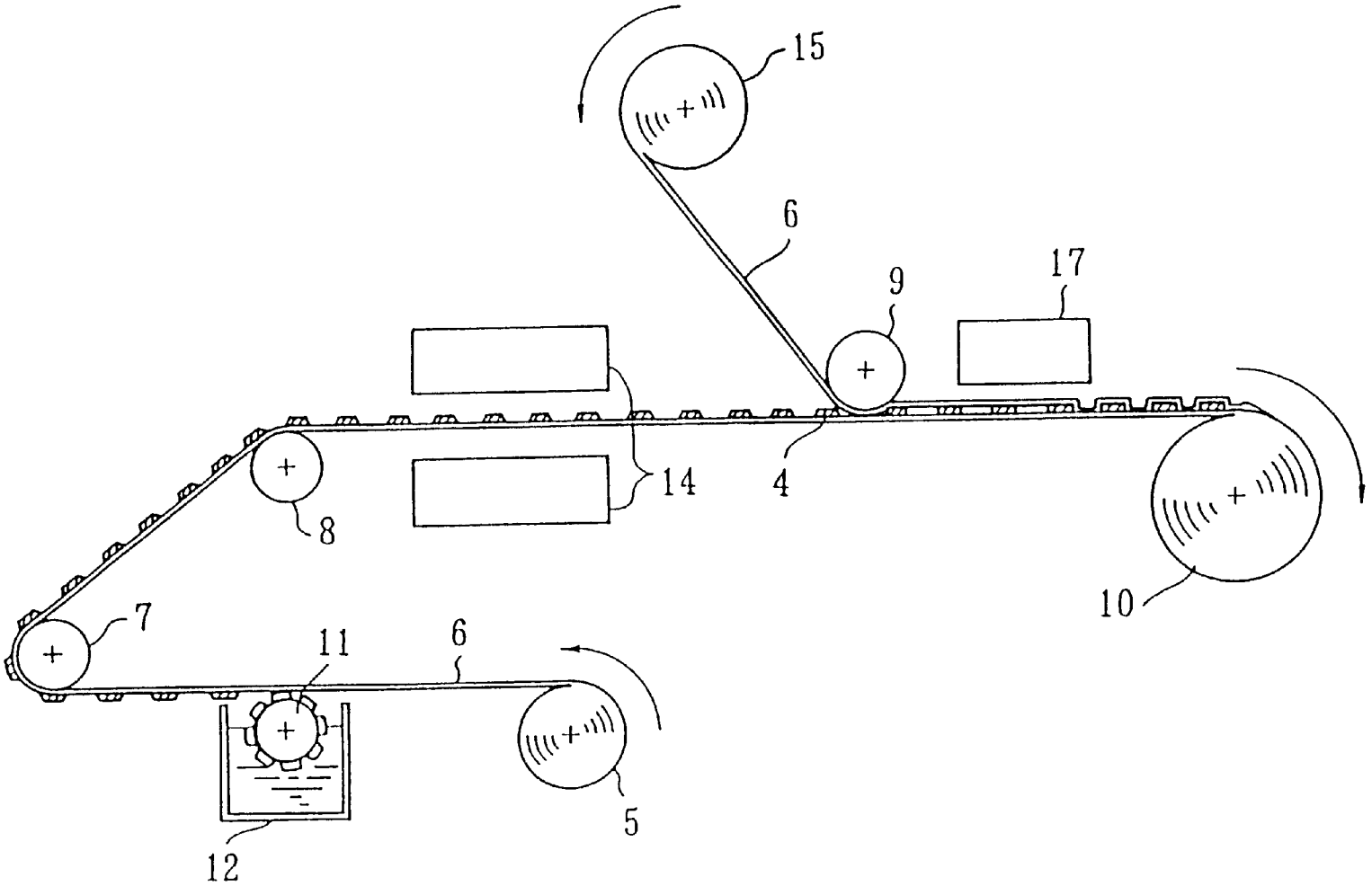
FIG. 3 is a production scheme of the process according to the present invention.
Figure 4:
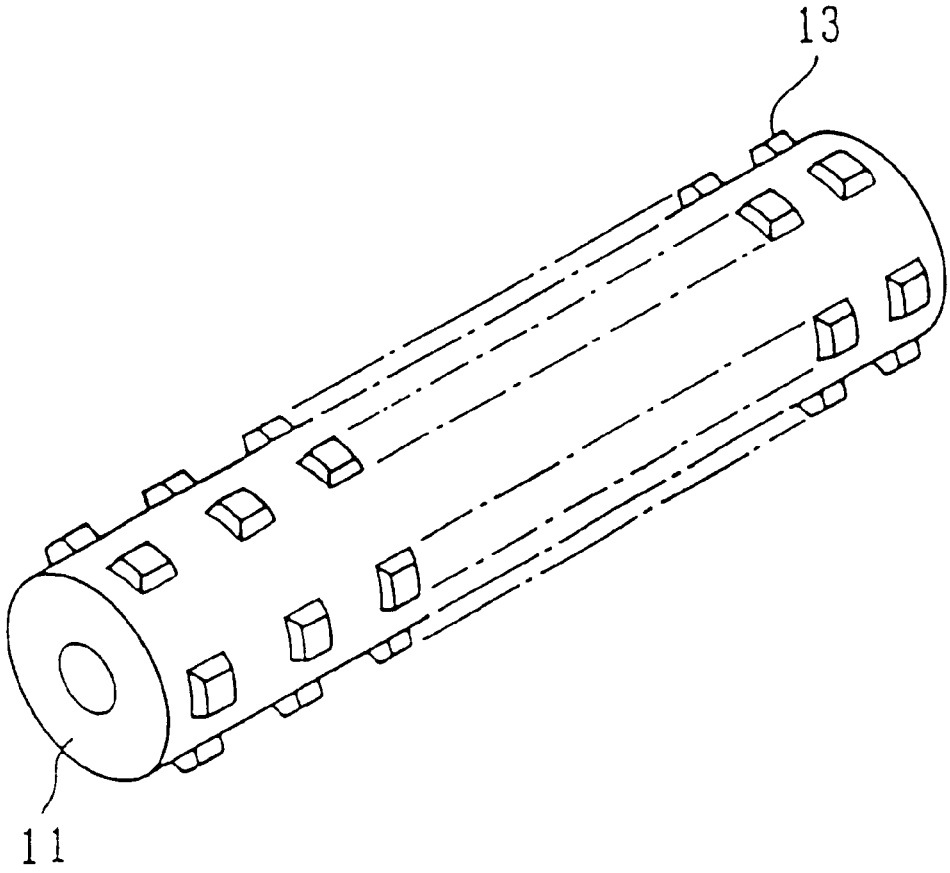
FIG. 4 is a squint view of a coating roll usable in the present invention.

In FIG. 3, reference numeral "5" is a base sheet reservoir roll, and base sheet 6 i transported from base sheet reservoir roll 5 to product-winding roll 10 via sending rolls 7, 8, and 9. Reference numeral "11" is a coating roll used for intermittently coating a solution of inclusion article 4 contained in reservoir tank 12 onto base sheet 6 at prescribed intervals. As shown in FIG. 4, coating roll 11 is a conventional roll provided with projections 13 around the roll, and the rotation of coating roll 11 intermittently coats a solution of an inclusion article, which adheres to the edges of projections 13, onto prescribed sections of base sheet 6 while base sheet 6 is being sent out. Reference numeral "14" is a dryer used for drying the solution coated onto base sheet 6 with hot air or far infrared rays. Reference numeral "15" is a reservoir roll for overlapping sheet 16, and from which overlapping sheet 16 is sent out via roll 9 to be laminated onto the upper side of base sheet 6. Reference numeral "17" is a sealing machine such as a heat sealer used for sealing appropriate sections of base sheet 6 and overlapping sheet 16 to enclose thin leaf inclusion article 4 in inclusion cell 2 formed between base sheet 6 and overlapping sheet 16 so that the inclusion article 4 can be freely detached. The inclusion packaged product thus obtained is wound by product-winding roll 10. The wound product is cut to the desired size, depending upon the ultimate purpose.

The production scheme of FIG. 3 is only an example of a roller coating using coating roll 11, and the present process should not be restricted to the coating method. Other conventional coating methods, such as gravure coating, bar coating, air-knife coating, screen coating, etc., can be used in the present invention. referring to coating roll 11 in FIG. 4, a plurality of row of projections 13 are provided. However, the number of rows can be changed depending on the needs.

The following examples explain the present invention in more detail:

EXAMPLE 1

Cachou

| Ingredients | Content (part by weight) |
|---|---|
| Pullulan | 19.2 |
| Locust bean gum | 1.2 |
| Glycerin | 0.1 |
| Sorbitol | 0.8 |
| Dextrin (DE 25) | 3.8 |
| Water | 71.0 |
| Emulsified Japanese mint oil | 3.0 |
| ASPARTAME, a synthetic peptide sweetener commercialized by Ajinomoto co. Ltd., Tokyo, Japan | 0.3 |
| Citric acid | 0.3 |
| Sucrose fatty acid ester | 0.3 |

An aqueous solution consisting of the above ingredients was prepared and poured into reservoir tank 12 in FIG. 3, and polyethylene sheets 1.1 m wide, 30 and 10 $\mu$m thick, as base sheet 6 and overlapping sheet 16, respectively, were sent to a roller coating machine and moved at a rate of 7 m/min. A hot air blowing type dryer was used as dryer 14, and air heated to 80° C. was blown onto the contents from the lower and upper sides of base sheet 6. The edge of projection 13 on coating roll 11, shaped to form thin leaf inclusion article 4 with a size of 2×30 mm after drying, formed on base sheet 6. Thus, a wide and long inclusion packaged product was obtained with regularly repeating rows of 27 inclusion cells enclosing thin leaf cachou, about 30 $\mu$m thick, spaced one centimeter apart and placed at regular intervals of about one centimeter as a sealed section in the width direction of base sheet 6.

In this product, the thin leaf inclusion cachous are distributed to inclusion cells 2 formed between base sheet 6 and overlapping sheet 16. One can enjoy a refreshing flavor and sweetness throughout the mouth by removing them from the package and placing them in the mouthy. The inclusion packaged product can be cut to appropriate size, for example, cut into about one to ten sets of inclusion cells, which can be easily curled or folded for easy carrying in bags or pockets. One can freely remove and taste them even in front of other to prevent unsatisfactory mouth odor and refresh one's taste without offending public manners and etiquette in public places.

EXAMPLE 2

| Sweetener | |
|---|---|
| Ingredients | Content (part by weight) |
| Pullulan | 25.0 |
| ASPARTAME, a synthetic peptide sweetener commercialized by Ajinomoto Co. Ltd., Tokyo, Japan | 4.0 |
| Sucrose fatty acid ester | 0.3 |
| Water | 70.0 |

Similarly as in Example 1 except for using both an aqueous solution consisting of the above ingredients and polypropylene sheets 30 $\mu$m thick and 1.1 meter wide each, as base sheet 6 and overlapping sheet 16 in FIG. 3, was produced a relatively wide and long inclusion packaged product with regularly repeating rows of 27 inclusion cells that enclosed thin leaves of sweeteners, about 50 $\mu$m thick and 20×20 mm each, spaced one centimeter apart and placed at regular intervals of about one centimeter as a sealed section in the width direction of base sheet 6.

The inclusion packaged product, enclosing thin leaves of sweeteners, can sweeten a cup of coffee with only one piece of such a thin leaf enclosed in each inclusion cell. The product is easily handled and the thin leaves are prevented from contact with the atmosphere. Because of these, one can cut the packaged products into appropriate sizes and use them even outdoors without any inconvenience.

EXAMPLE 3

| Seasoning | |
|---|---|
| Ingredients | Content (part by weight) |
| Powder of dried bonito flakes | 2.0 |
| Powder of parched sesame | 12.0 |
| Soy sauce | 1.0 |
| Pullulan | 25.0 |
| Sucrose fatty acid ester | 1.0 |
| Water | 75.0 |

A relatively wide and long inclusion packaged product with regularly repeating rows of 15 inclusion cells enclosing thin leaves of seasonings, about 60 $\mu$m thick and 50×50 mm each, spaced one centimeter apart and placed at regular intervals of about one centimeter as a sealed section in the width direction of base sheet 6 was obtained similarly as in Example 1, using a homogeneously mixed suspension of the above ingredients and Japanese paper 1.1 m wide, laminated with 30 $\mu$m thick polyethylene sheets as base sheet 6 and overlapping sheet 16.

The thin leaves enclosed in the inclusion packaged product have a satisfactory flexibility and long endurance, and maintain their color, gloss, flavor, and taste for a relatively long period of time. Because of these properties, it can be suitably used as a material for rolling foods such as "onigiri", a rice ball.

EXAMPLE 4

| Medicament | |
|---|---|
| Ingredients | Content (part by weight) |
| Aspirin | 1.0 |
| Pullulan | 15.0 |
| Mannan | 3.0 |
| Fatty acid glycerol ester | 1.0 |
| Water | 80.0 |

Similarly as in Example 1 except for using an aqueous solution consisting of the above ingredient, and polyacrylic acid sheets, 40 $\mu$m thick and 1.1 m wide each, as base sheet 6 and overlapping sheet 15 in FIG. 3, was obtained a relatively wide and long inclusion packaged product with regularly repeating rows of 22 inclusion cells enclosing thin leaves of aspirin, about 30 $\mu$m thick and 30×40 mm each, spaced one centimeter apart and placed at regular intervals of about one centimeter as a sealed section in the width direction of base sheet 6.

The inclusion packaged product gradually releases aspirin with an analgesic-antipyretic activity, preventing a rapid increase in the concentration of aspirin in the intestines after administration, and retains a satisfactory effect for a relatively long period of time. In the product, a thin leaf as a dose is physically separated from the atmosphere so that the product can be cut into appropriate pieces to optimize ease of carrying for use outdoors and on trips.

EXAMPLE 5

| Cosmetic | |
|---|---|
| Ingredients | Content (part by weight) |
| Pullulan | 4.2 |
| Gum arabic | 0.5 |
| Carrageenan | 0.1 |
| Water | 43.7 |
| Titanium oxide | 19.0 |
| Barium sulfate | 1.5 |
| Red iron oxide | 4.0 |
| Yellow iron oxide | 1.5 |
| Black iron oxide | 0.3 |
| Talc | 0.5 |
| Lecithin | 0.5 |
| Polyoxyethylene sorbitan monooleate (20 E.O.) | 0.2 |
| Propylene glycol | 11.0 |
| Dimethylpolysiloxane | 13.0 |

A relatively wide and long inclusion packaged product with regularly repeating rows of 15 inclusion cells, enclosing thin leaves of foundation, about 60 $\mu$m thick and 50×50 mm each, spaced one centimeter apart and placed at regular intervals of about one centimeter as a sealed section in the width direction of base sheet 6 was obtained similarly as in Example 1, using an aqueous solution consisting of the above ingredients and polypropylene sheets, 20 μm thick and 1.1 m wide each as base sheet 6 and overlapping sheet 16 as shown in FIG. 3, and moving the sheets at a rate of 5 m/min.

The inclusion packaged product is easily transportable, sufficient in strength, and satisfactory in gloss, and does not become sticky when handled while maintaining its smooth surface. When wiped with a moistened sponge, the film easily dissolves and had satisfactory handleability and waterproofing.

EXAMPLE 6

| Seed | |
|---|---|
| Ingredients | Content (part by weight) |
| Pullulan | 25.0 |
| Locust bean gum | 5.0 |
| Sucrose fatty acid ester | 1.0 |
| Parsley seed | 4.0 |
| Water | 65.0 |

A relatively wide and long inclusion packaged product with regularly repeating rows of 15 inclusion cells, enclosing thin leaves of seeds, about 100 μm thick and 50×50 mm each, spaced one centimeter apart and placed at regular intervals of about one centimeter as a sealed section in the width direction of base sheet 6 was obtained similarly as in Example 1, using an aqueous solution consisting of the above ingredients and polypropylene sheets, 30 μm thick and 1.1 m wide each as base sheet 6 and overlapping sheet 16 as shown in FIG. 3. The dryer 14 used was a hot air blowing type dryer, and drying was conducted at a relatively low temperature.

The inclusion packaged product maintains a relatively high germination rate of the seeds for a satisfactorily long period of time. Since the thin leaves are packed in the cells, they are prevented from being melted by perspiration when handled, and this facilitates planting the seeds. Also, the leaves are readily dissolved by water sprinkled after seeding, which results in exposure and germination of the seeds.

As described above, the present invention relates to a completely novel inclusion packaged product which is easily handled and transported. Since the thin leaf inclusion articles packed in the product are not in contact with the atmosphere, there is substantially no sanitary problem. The product is easily produced by the process according to the present invention.

The present invention with such an outstanding effect would significantly contribute to this art.

While there has been described what is at present considered to be the preferred embodiments of the invention, it will be understood that various modifications may be made thereto, and it is intended to cover in the appended claims all such modifications as fall within the true spirit and scope of the invention.

What is claimed is:

1. A process for producing inclusion packaged products, said product comprising:

(i) an inclusion cell formed from a base sheet and an overlapping sheet, wherein the base sheet and the overlapping sheet each has a thickness of about 1–100 microns, and the thickness of the overlapping sheet is not greater than that of the base sheet; and (ii) a thin-leaf inclusion article, comprising a water soluble polymer in the form of a thin film having a thickness of about 10–500 microns, which inclusion article is obtained by providing about 10–50 w/w % solution of the thin-leaf inclusion article and one or more ingredients selected from the group consisting of ingredients, cosmetic ingredients, and pharmaceutical ingredients, depositing the solution onto a prescribed portion of the base sheet, and then evaporating the solvent from the solution by a dryer at a temperature of 40–100° C. to dry and form the thin-leaf inclusion article, said process comprising:

(1) placing the overlapping sheet over the thin-leaf inclusion article; and (2) sealing appropriate selections of the overlapping sheet onto the base sheet to create the inclusion cell to enclose the thin-leaf inclusion article which is adhered to the base sheet and which is smaller than the inclusion cell, whereby the thin-leaf inclusion article can be freely detached from the base sheet.

2. The process according to claim 1 wherein said solution is applied to prescribed areas on said base sheet at prescribed intervals.

3. The process according to claim 1 wherein said base sheet and said overlapping sheet are heat sealed.

4. The process according to claim 1 wherein said water soluble polymer is selected from the group consisting of amylose, gum arabic, sodium alginate, elsinan, curdlan, carrageen, karaya gum, agar, xanthan gum, chitin, guar gum, quince seed gum, mannan, gelatin, cellulose, tamarind gum, dextran, starches, tragacanth gum, pectin, pullulan, polyvinyl alcohol, locust bean gum, and derivatives thereof.

5. The process according to claim 1 wherein the concentration of said water soluble polymer is about 10–50 w/v %.

6. The process according to claim 1 wherein the thickness of said overlapping sheet is not greater than the thickness of said base street.

7. The process according to claim 1 wherein said base sheet and said overlapping sheet are made of one or more synthetic polymers, semisynthetic polymers, and natural polymers.

8. The process according to claim 7 wherein said polymers are selected from the group consisting of polyethylene, polypropylene ethylene/vinyl acetate polymer, polyvinyl acetate, polyvinyl chloride, polyvinylidene chloride, polytetrafluoroethylene, polyvinylidene fluoride, polystyrene, polyacrylonitrile, polyacrylate, polymethacrylic acid, ethylene polypropylene copolymer, ethylene/acrylic acid copolymer, ethylene/methacrylic acid copolymer, propylene/vinylchloride copolymer, ethylene/vinyl alcohol copolymers, polyethylene terephthalate, polybutylene terephthalate, polycarbonate, nylon, normal cellophane, moistureproof cellophane, cellulose acetate, carboxymethyl cellulose, polyvinyl alcohol, hydrochlorinated rubber, paper, and aluminum foil.

9. The process according to claim 1 wherein said solution contains a surfactant.

10. The process according to claim 9 wherein said surfactant is selected from the group consisting of sucrose fatty acid ester, maltose fatty acid ester, maltitol fatty acid ester, trehalose fatty acid ester, and fatty acid glycerol ester.

* * * * *